US006874633B2

(12) United States Patent
Andersen et al.

(10) Patent No.: US 6,874,633 B2
(45) **Date of Patent: *Apr. 5, 2005**

(54) TEMPORARY PACKAGE AND METHOD

(75) Inventors: Dale C. Andersen, Fridley, MN (US); Donald J. Lasecke, Arden Hills, MN (US)

(73) Assignee: Delkor Systems, Inc., Circle Pines, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/335,579

(22) Filed: Dec. 31, 2002

(65) Prior Publication Data

US 2003/0150760 A1 Aug. 14, 2003

Related U.S. Application Data

(60) Continuation of application No. 09/447,751, filed on Nov. 22, 1999, now Pat. No. 6,499,596, which is a division of application No. 09/080,609, filed on May 18, 1998, now Pat. No. 6,182,422.

(51) Int. Cl.[7] ..... B65D 81/00
(52) U.S. Cl. ..... 206/427; 206/460; 206/497
(58) Field of Search ..... 206/144, 192, 206/427, 432, 460, 497, 499, 526; 53/398, 441, 442

(56) References Cited

U.S. PATENT DOCUMENTS

| | | | |
|---|---|---|---|
| 1,981,647 A | 11/1934 | Johnson | 224/45 |
| 2,313,731 A | 3/1943 | Brogden | 229/52 |
| 2,774,474 A | 12/1956 | Phillips | 206/65 |
| 2,810,476 A | 10/1957 | Guyer | 206/65 |
| 2,835,381 A | 5/1958 | Ackermann et al. | 206/65 |
| 3,047,144 A | 7/1962 | Wissel | 206/83 |
| 3,164,252 A | 1/1965 | Hosbein | 206/65 |
| 3,198,327 A | 8/1965 | Boehling et al. | 206/65 |
| 3,253,707 A | 5/1966 | Gooding | 206/65 |
| 3,312,340 A | 4/1967 | Face | 206/80 |
| 3,319,783 A | 5/1967 | Henrici et al. | 206/65 |
| 3,331,503 A | 7/1967 | Brown | 361/214 |

(Continued)

FOREIGN PATENT DOCUMENTS

| | | |
|---|---|---|
| CA | 1191819 | 8/1995 |
| DE | 28 36 533 | 2/1990 |
| EP | 0 511 134 A1 | 10/1992 |
| FR | 2 387 172 | 10/1978 |
| FR | 2 581 038 | 10/1986 |
| WO | 96/17791 | 6/1996 |

OTHER PUBLICATIONS

Dairy Industry Pioneers New Reduced Shipper, *Dairy Field*, p. 42, Feb. 1992.
Beyond the Corrugated Box, Innovative package offers U.S. Dairies a new alternative, *Dairy Foods*.
Savings Come as Shippers go, *Packaging Digest*, Dec. 1991.

*Primary Examiner*—Jim Foster
(74) *Attorney, Agent, or Firm*—Vidas, Arrett & Steinkraus P.A.

(57) ABSTRACT

A temporary packaging method and a resultant package are provided for comprising temporarily bonding containers on a flat base member to stabilize the containers for further packaging, the method comprising the steps of providing a base member, providing containers, temporarily bonding the containers to the base member with a hot melt adhesive, advancing the base member with containers through the packaging or handling system so that further processing of the containers may optionally be effected, encapsulating the base member and bonded containers with a plastic shrink film to complete the package, followed by release of the containers from the bond to base member within minutes after shrink wrapping, with the adhesive remaining bonded to the base member.

3 Claims, 8 Drawing Sheets

U.S. PATENT DOCUMENTS 3,343,903 A 9/1967 Roy ..... 312/285
3,347,365 A 10/1967 Funkhouser ..... 206/65
3,389,784 A 6/1968 Hendricks et al. ..... 206/47
3,487,918 A 1/1970 Roden et al. ..... 206/65
3,522,688 A 8/1970 Kaliwoda et al. ..... 53/30
3,542,193 A 11/1970 Hewlett et al. ..... 206/65
3,638,790 A 2/1972 Schmid et al. ..... 206/65 S
3,665,674 A 5/1972 Bivans et al. ..... 53/74
3,667,598 A 6/1972 Selnick et al. ..... 206/65 S
3,675,767 A 7/1972 Taylor ..... 206/65 S
3,719,018 A 3/1973 Focke et al. ..... 53/26
3,734,280 A 5/1973 Amneus et al. ..... 206/65 R
3,878,943 A 4/1975 Ryan et al. ..... 206/497
3,883,000 A 5/1975 Gibbs ..... 206/432
3,885,671 A 5/1975 Spiegel et al. ..... 206/460
3,946,862 A 3/1976 Klygis et al. ..... 206/150
4,036,362 A 7/1977 Ullman ..... 206/432
4,050,579 A 9/1977 Gorski et al. ..... 206/460
4,053,049 A 10/1977 Beauvais ..... 206/318
4,055,249 A 10/1977 Kojima ..... 206/447
4,078,357 A 3/1978 Ida ..... 53/26
4,130,200 A 12/1978 Iepson et al. ..... 206/333
4,177,895 A 12/1979 Shelton ..... 206/386
4,304,332 A 12/1981 Danti ..... 206/432
4,387,808 A 6/1983 Dornbusch ..... 206/432
4,444,311 A 4/1984 Rias ..... 206/391
4,505,389 A 3/1985 Whiteside ..... 206/460
4,523,676 A 6/1985 Barrash ..... 206/150
4,625,864 A 12/1986 Nigrelli ..... 206/427
4,730,730 A 3/1988 Clarkson ..... 206/497
4,730,732 A 3/1988 Wagonseller ..... 206/597
4,801,024 A 1/1989 Flum et al. ..... 211/59.4
4,821,880 A 4/1989 Ditton ..... 206/386
4,919,265 A 4/1990 Lems et al. ..... 206/432
4,930,633 A 6/1990 Gloyer ..... 206/428
4,942,720 A 7/1990 Berney ..... 53/447
4,962,625 A 10/1990 Johnson et al. ..... 53/157
4,998,619 A 3/1991 Sowa et al. ..... 206/392
5,035,323 A 7/1991 Daniels et al. ..... 206/386
5,069,338 A 12/1991 Grigsby ..... 206/319
5,083,674 A 1/1992 Clark ..... 220/4.27
5,139,145 A 8/1992 Cook ..... 206/386
5,213,211 A 5/1993 Umiker ..... 206/392
5,228,564 A 7/1993 Randeria ..... 206/45.14
5,259,524 A 11/1993 Eckert ..... 220/23.4
5,269,645 A 12/1993 Winski ..... 414/786
5,314,557 A 5/1994 Schwartz et al. ..... 156/229
5,423,428 A 6/1995 Selz ..... 206/597
5,450,708 A 9/1995 Lashyro ..... 53/399
5,487,471 A 1/1996 Marchek et al. ..... 206/725
5,607,056 A 3/1997 Whiteside ..... 206/427
5,692,612 A 12/1997 Weder et al. ..... 206/423
5,701,721 A 12/1997 Weder et al. ..... 53/397
5,887,717 A 3/1999 Anderson et al. ..... 206/460
6,182,422 B1 2/2001 Andersen et al. ..... 53/442
6,499,596 B1 12/2002 Andersen et al. ..... 206/427

TEMPORARY PACKAGE AND METHOD

CROSS-REFERENCE TO RELATED APPLICATIONS

This application is a continuation from application Ser. No. 09/447,751, filed Nov. 22, 1999 U.S. Pat. No. 6,499,596, issued Dec. 31, 2002 which is a divisional of application Ser. No. 09/080,609, filed May 18, 1998, now U.S. Pat. No. 6,182,422, issued Feb. 6, 2001, the contents of which is hereby incorporated by reference.

BACKGROUND OF THE INVENTION

1. Field of the Invention

This invention relates to a method for package assembly, and more particularly to a method for briefly stabilizing containers on a flat base member by temporarily bonding the containers to the base member with a hot melt adhesive that releases the container from its bond to the base member soon after the handling and packaging process is complete, and a package which consists of a rigid base member, containers temporarily bonded with hot melt adhesive to the base member, and a plastic shrink film encapsulating the base member and containers.

2. Description of the Related Art

Prior art packaging methods and packages do not address the special need of stabilizing containers on a flat base member during the brief period of package assembly by forming a temporary adhesive bond between the containers and the base member.

Placement of a group or pack pattern of containers on a flat base member poses a stability problem as the base member with containers is transported through a packaging or handling process. This is particularly a problem for intermittent motion packaging or handling systems, but is also a concern for continuous motion equipment. Even the machine vibration on a continuous motion machine can result in movement of containers on the flat base member, which can negatively effect the completed package, or the effectiveness of the packaging or handling system.

To avoid this instability with containers on a flat base member, many packaging or handling systems use a corrugated box or tray with four side walls. The box or tray forms a containment boundary so that movement of the containers during the handling or packaging process minimizes the stability problem.

A need exists for a temporary packaging method and package so that containers are restricted from movement when placed on a flat base member during the packaging or handling process, yet upon completion of the packaging or handling, the containers are free of this movement restriction.

SUMMARY OF THE INVENTION

Accordingly, the present invention provides a temporary packaging method and package which briefly bonds a group or pack pattern of containers to a flat base member to stabilize the containers during the handling or packaging process, and these containers release from this adhesive bond soon after the handling or packaging process is completed by plastic shrink film encapsulation of the base member and containers. The method comprises the steps of providing a base member, providing adhesive to the base member, placement of containers to base member resulting in a temporary bond, advancing the base member with bonded containers through the handling or packaging process, encapsulation of base member and containers with plastic shrink film, and release of containers from bond to base member within minutes after the encapsulation by shrink film, with adhesive remaining bonded to base member.

The method of the present invention eliminates the instability of the containers on a flat base member during the handling or packaging process, thereby permitting a wide range of movement and handling to occur. The present invention permits the group of containers which are bonded to the flat base member to be aggressively handled by inclines, declines, side transfers, abrupt starting and stopping, equipment vibration, stacking, etc.

The temporary bond effectively locks the containers in place during the handling or packaging process. This temporary bond is defined herein as a bond that releases by itself over time. It is required to hold the containers in place during the handling or packaging process, and within minutes after the base member and containers are encapsulated by film, the container releases from the base member with the adhesive residue remaining on the base member.

This novel packaging method dramatically simplifies the packaging and handling process for packaging containers on a flat base member. By temporarily stabilizing the group or pack pattern on the base member during the packaging or handling process, this invention offers an effective alternative to the traditional corrugated box or tray with four side walls.

This invention utilizes less packaging materials than boxes or trays, is more cost efficient, and because there is no need to form boxes or trays, which generate both corrugated dust and spores, it is more sanitary. This invention also offers greater efficiency than current methods of packaging containers on flat base members because of the increased stability of containers on the base member during package assembly.

DESCRIPTION OF THE PREFERRED EMBODIMENTS

Figure 1:
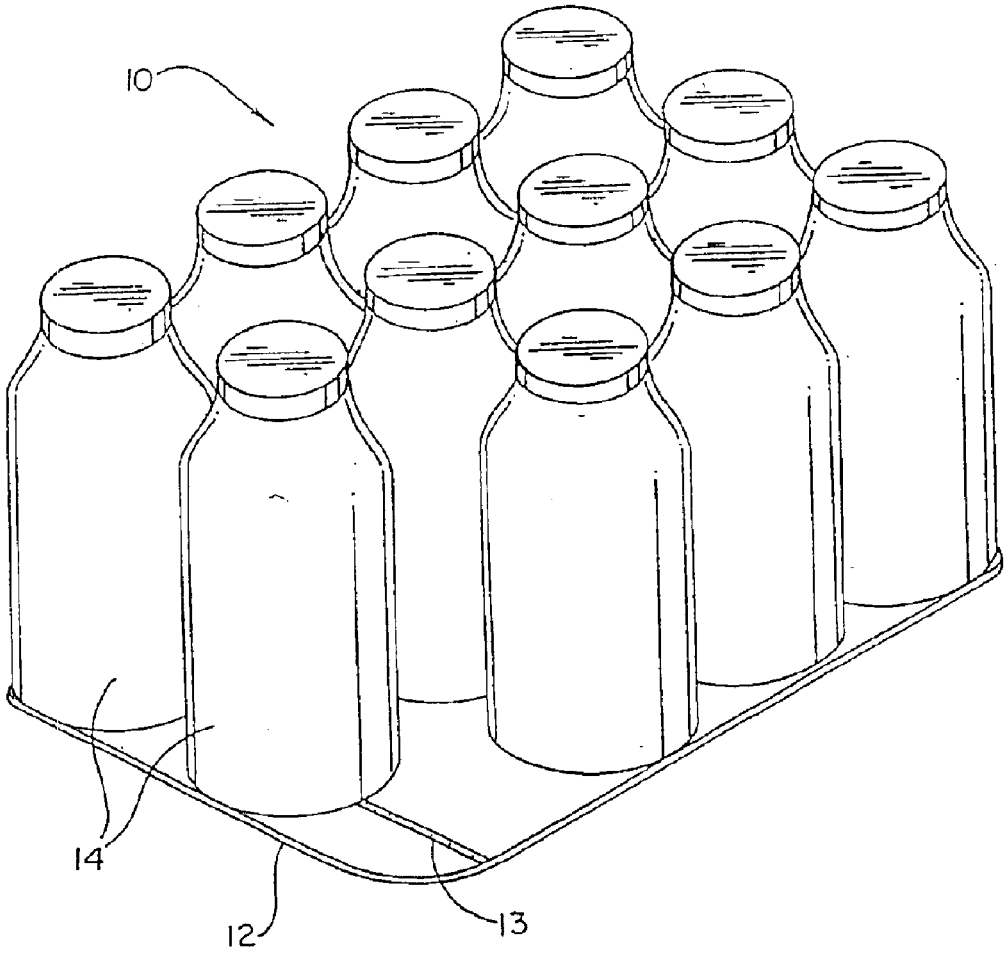
FIG. 1 is a perspective view of a grouping of containers of the present invention showing a base member with containers adhered thereto.

While this invention may be embodied in many different forms, there are shown in the drawings and described in detail herein specific preferred embodiments of the invention. The present disclosure is an exemplification of the principles of the invention and is not intended to limit the invention to the particular embodiments illustrated.

The present invention provides a temporary packaging method and package which briefly bonds a group or pack pattern of containers to a flat base member during the handling or packaging process and releases this bond once the handling or packaging process is completed. The method comprises the steps of providing a base member, providing adhesive to the base member, placement of containers on base member to form a temporary bond, optionally adding a top cover member or divider, advancing the base member with bonded containers through the handling or packaging process so that further processing of the containers may optionally be effected, encapsulation of the base member with bonded containers by a plastic shrink film, followed by release of containers from base member soon after encapsulation of the shrink film, with adhesive remaining bonded to base member.

The method of the present invention provides a means for briefly bonding containers to a base member so containers can be effectively controlled during the handling or packaging process. The optional top cover member adds extra strength and protection for certain container types such as those having foil or paper lids or a bottle with a sport cap, the optional divider insert adds extra protection for certain container types such as glass bottles or jars to avoid glass on glass contact.

Referring to FIG. 1, an assembly of containers of the present invention is shown generally at 10 and comprises a flat base member 12, onto which containers are adhered to temporary bonding adhesive strips 13.

Base member 12 may be made of any suitable material such as chip board, paper board or corrugated board depending on the dimensions of the package and intermediate steps which accompany the packaging method. Chip board, however, possesses the minimum desired degree of stiffness according to the present invention.

Figure 2:
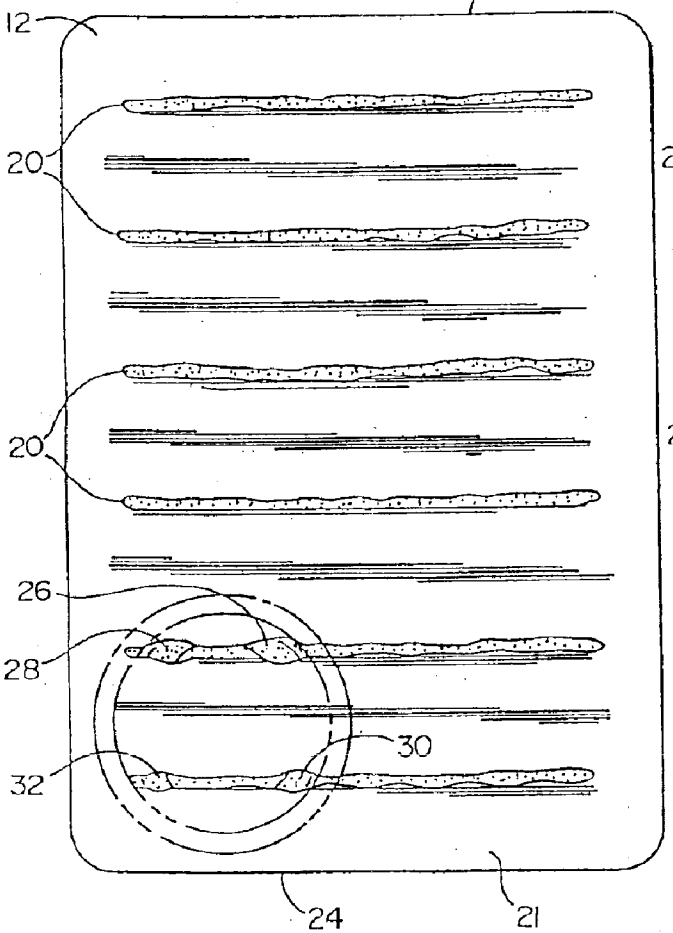
FIG. 2 is a plan view of a base member with continuous strips of a temporary adhesive applied thereto.

By means of appropriate adhesive dispensing equipment the nature of which will be readily apparent to those familiar with the art, strips of adhesive 20 are placed on the upper surface 21 of base member 12, as shown in FIG. 2, adhesive strips 20 being disposed parallel to ends 22 and 24 of base member 12. The adhesive is a hot melt adhesive which may be applied by applicators situated above a conveyor (not shown) along which base member 12 is traveling during the packaging process. Both the application temperature and depth of adhesive strip should be consistent with the strips of adhesive 20 on base member 12.

The timing between application of adhesive strips and placement of containers should be substantially consistent, generally 2 to 3 seconds between placement of adhesive strips on base member and placement of containers on base member.

In order to form a temporary bond, the hot melt adhesive should have an open time of approximately 30 to 45 seconds. The open time is defined as the period between application of adhesive on base member and solidification of adhesive. During the open time the elasticity of the semi-solid hot melt adhesive permits aggressive movement of the base member without movement of the containers from their position on the base member. As the adhesive begins to solidify the bond weakens and within minutes the container totally releases from the bond to base member, with all adhesive remaining on the base member.

An adhesive with this characteristic is commercially available from H. B. Fuller as Product No. H.L. 7674. Depending upon the type of handling contemplated, however, the specific open time may vary. In general, an open time of between 20 seconds to 1 minute is particularly well suited for the present invention.

The specific bonding strength between base member and container is controlled by varying the application temperature of the adhesive, and the depth of the adhesive strips (generally 1/16 to 1/8" depth). A higher application temperature and deeper adhesive strips will increase the bonding, and a lower temperature and thinner adhesive strips will decrease bonding. In general, the hot melt adhesive is preferably applied within a temperature range of 270 degrees F. to 340 degrees F.

Adhesive strips 20 hold containers 14 firmly in place on base member 12, as shown in FIG. 1. The adhesive is such that it will adhere to containers 14 to the extent that containers 14 are secured to base member 12 firmly enough to resist movement relative thereto and provide stability during normal handling.

Figure 3:
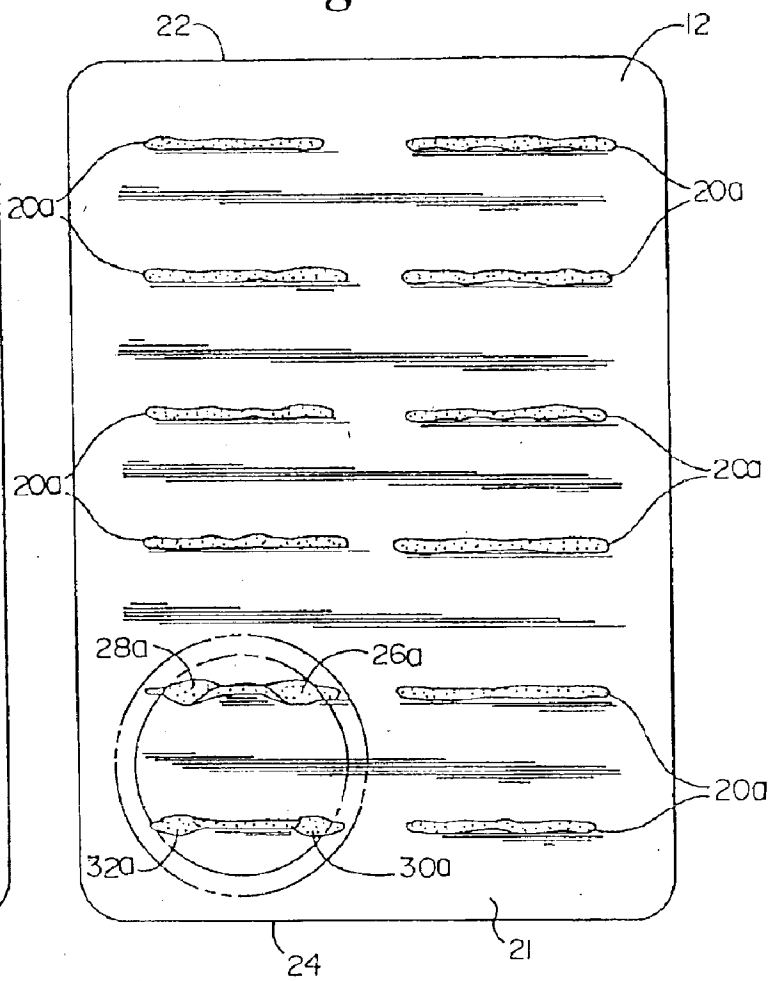
FIG. 3 is a plan view of a base member with intermittent strips of a temporary adhesive applied thereto.

FIG. 3 shows an alternative embodiment of the invention, in which adhesive strips 20*a* are intermittent, so that the adhesive strips extend only beneath the individual containers and not between them.

Soon after the adhesive is applied to base member 12 (generally 2 to 3 seconds), containers are placed in an adjacent side by side relationship on adhesive strips 20 on base member 12, as shown in FIG. 1. Containers 14 may be positioned on base member 12 by equipment which feeds containers 14 in a direction perpendicularly to the direction in which base member is traveling, and then positions a pre-arranged set of containers 14 on base member 12 within a consistently short period of time (generally 2 to 3 seconds). Containers 14 preferably touch the adhesive strip at two contact points, or at four contact points, as shown in FIG. 2 at 26, 28, 30 and 32, in which strips of adhesive, after a container has been affixed thereto and removed, are shown for purposes of illustration.

The advantage of automatic loading of containers into a pack pattern and bonding same to a base member is that a stable unitized assembly is placed on the adhesive strips at the same time. The time interval between application of adhesive and placement of containers should remain substantially constant to replicate the bonding characteristics of container to base member. For this reason, automatic loading equipment is the most preferred method.

Figure 4:
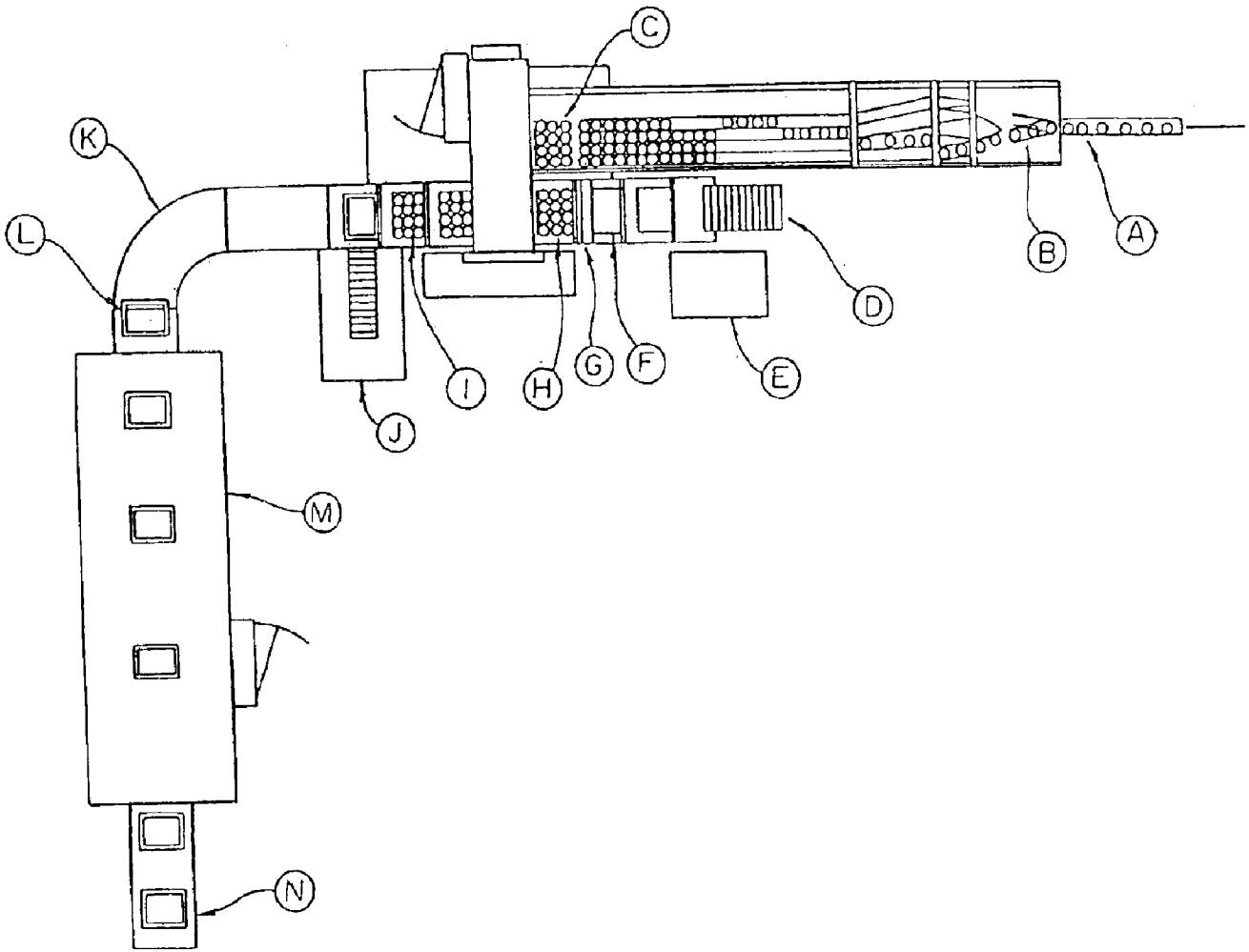
FIG. 4 is a diagram of the apparatus and method for assembling the package assembly of the present invention.

FIG. 4 is a diagram of the apparatus for assembling the package assembly and temporary packaging method of the present invention. Containers enter this apparatus on a single lane conveyor (A) and are channeled through lane dividers (B) which separate the containers into the appropriate number of lanes. A pack pattern of containers is released to collation area (C). Simultaneously a base member is picked from the base member magazine (D) and placed on the conveyor bed (F). As the base member indexes forward on the conyeyor bed the adhesive unit (E) and adhesive applicator (G) place strips of the temporary bonding hot melt adhesive on the base member.

The adhesive unit and applicator apply a consistent strip or strips of adhesive to the base member (generally 1/16" to ⅛" depth) at a consistent application temperature (generally 270 degrees F. to 340 degrees F.).

Within a consistent time period after application of adhesive to base member (generally 2 to 3 seconds), the pack pattern of containers (C) are transferred by the apparatus for placement on the base member with temporary bonding adhesive.

Once containers have been loaded onto the base member, the package assembly is moved by a conveyor through a series of optional applications such as placement of cover member or divider insert (J), conveying on inclines, declines or angled turns (K), abrupt stopping and starting (L), and transfer into the apparatus for encapsulating the base member and containers with plastic shrink film (M), and ending with the final package with shrink wrap encapsulation (N). Within minutes after shrink wrapping, the containers will release from the bond to base member with adhesive remaining bonded to base member.

Figure 5:
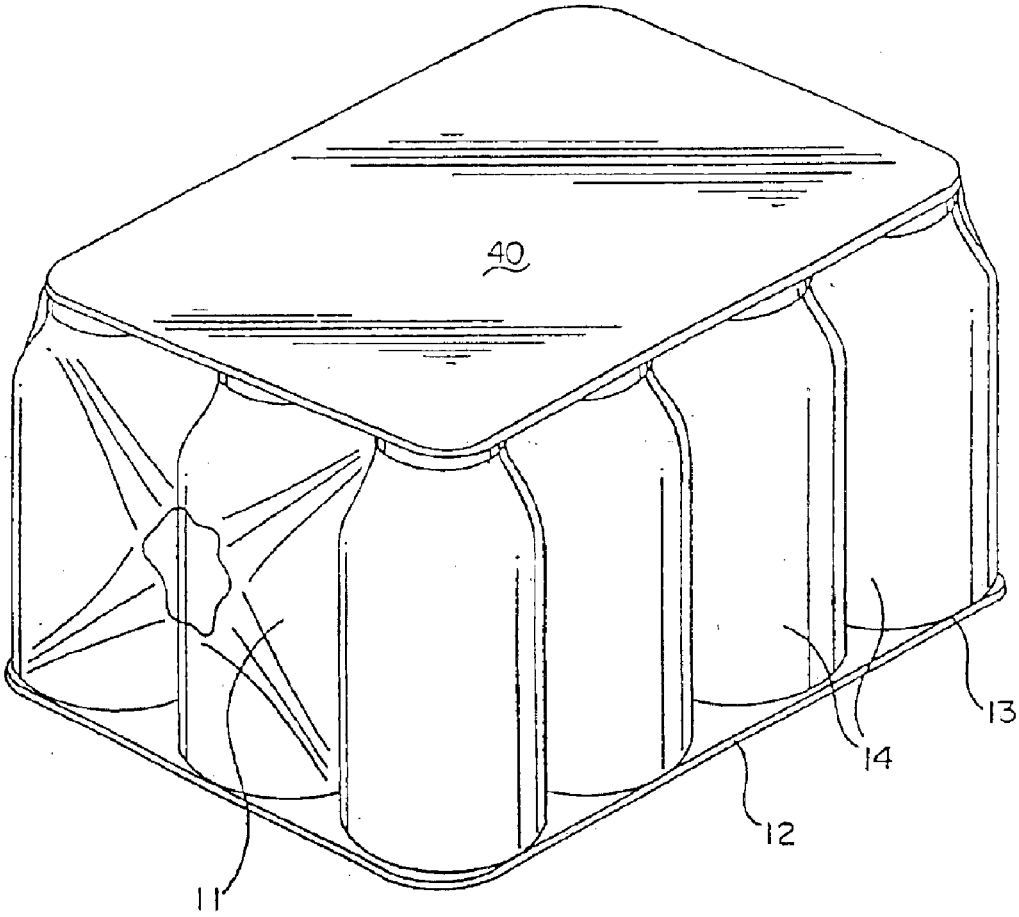
FIG. 5 is a perspective view of a base member with containers adhered thereto and having a cover member.

As shown in FIG. 5, a flat cover member 40 may optionally be applied over the containers. The cover member provides added strength to package and offers top layer protection for certain container types such as containers with paper or foil lids, or bottles with sport caps. Once cover member is in position, the package assembly is encapsulated with shrink film such as commercially available from Armin Plastics as Product No. 2304B. The tight film encapsulation thus provided keeps the top pad tightly pressed to the tops of the containers which increases package strength and protects the top layer of containers.

Figure 6:
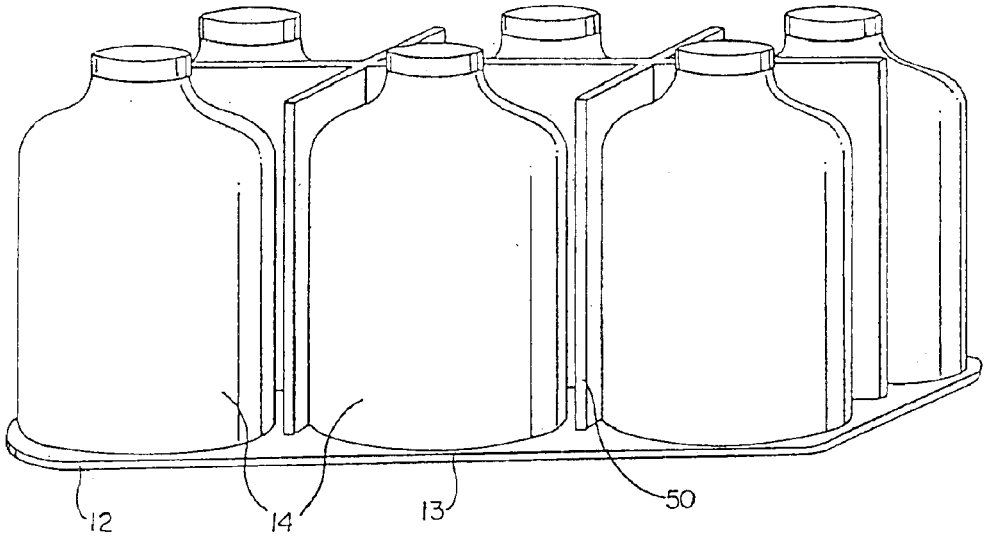
FIG. 6 is a perspective view of a base member with containers adhered thereto and having a divider insert.

An alternative embodiment of a temporary package assembly according to the present invention is shown at FIG. 6. A divider has been added to avoid container to container contact within package assembly. This has application for such containers as glass jars, bottles, vials, etc., in which container to container contact can result in damage during distribution. The divider (usually corrugated or chipboard) is placed between containers after containers are bonded to base member and prior to shrink film encapsulation.

Figure 7:
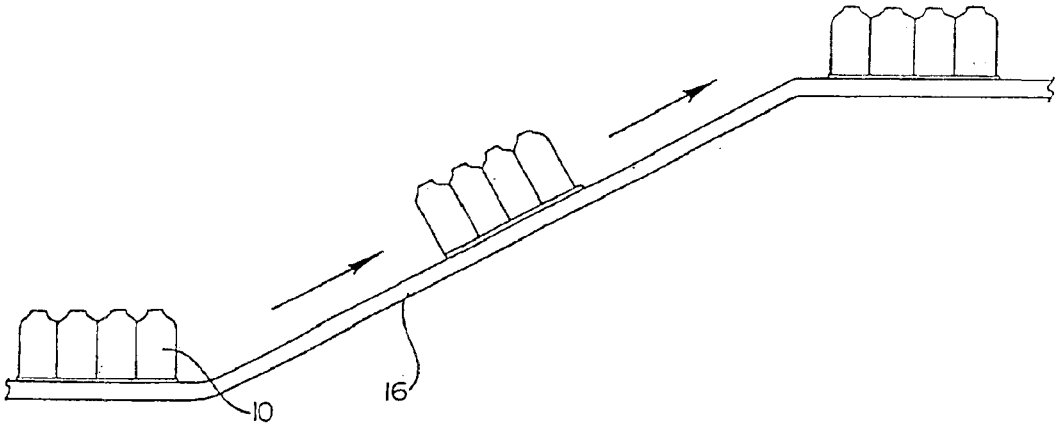
FIG. 7 is a perspective view of a grouping of containers of the present invention temporarily bonded to a base member and traveling up an incline prior to encapsulation by shrink film.

Referring to FIG. 7, a schematic drawing of the temporary package assembly according to the present invention is shown. Use of the flat base member and temporary adhesive bonding of containers to base member locks product containers in place and prevents individual movement of the containers until after the package assembly has been shrink wrapped. Within minutes the adhesive releases the containers from the bond to base member with the adhesive remaining on the base member. This temporary package assembly uses less packaging material than either a box or tray with four side walls, is more cost efficient, and because there is no need to form boxes or trays, which generate both corrugated dust and spores, it is more sanitary.

The present invention provides a method for temporarily bonding containers to a flat base member to restrict movement of containers on the base member during the handling or packaging process. This method of bonding the containers permits a wide range of movement and handling to occur without concern for container stability on the flat base member.

Figure 8:
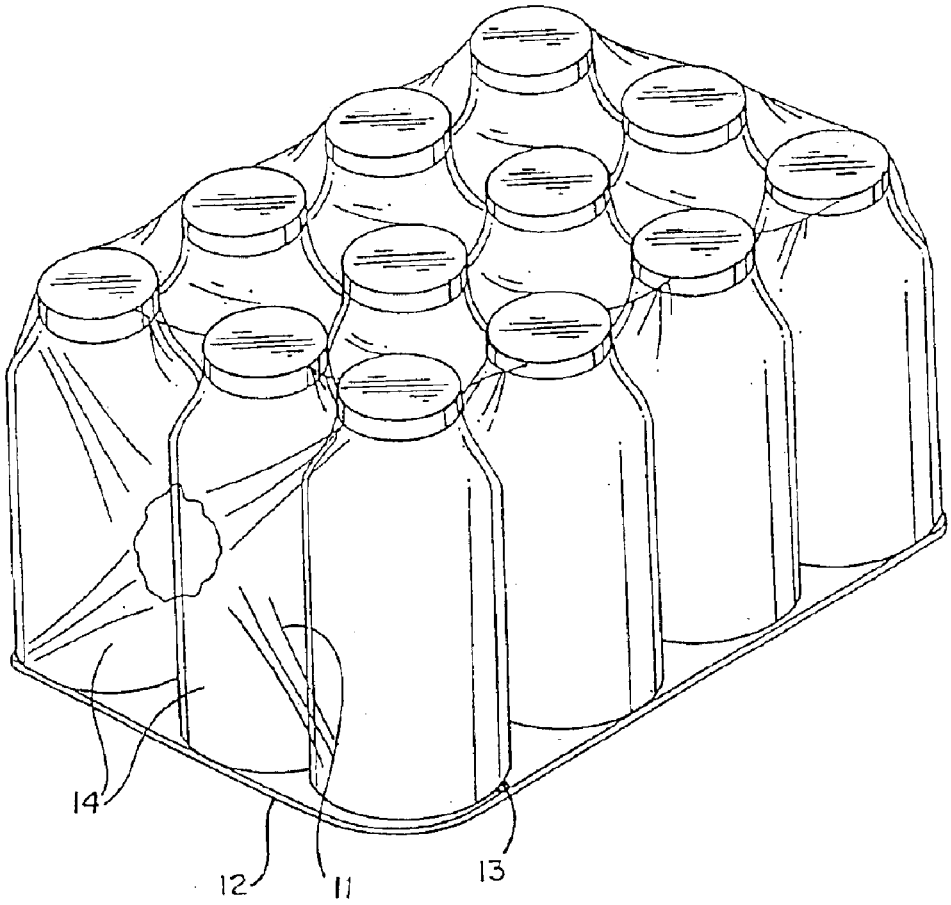
FIG. 8 is a perspective view of a grouping of containers of the present invention showing a base member with containers encapsulated with shrink film.

The present invention permits the group or pack pattern of containers to be aggressively handled by inclines as shown in FIG. 7, declines, side transfers, abrupt starting and stopping, equipment vibrations, stacking, etc., without individual movement of container, and within minutes after the group or pack pattern of containers and base member has been encapsulated with plastic shrink film, the adhesive bond releases the containers from the base member with the adhesive residue remaining on the base member. The completed package assembly of the present invention is shown in FIG. 8.

Figure 9:
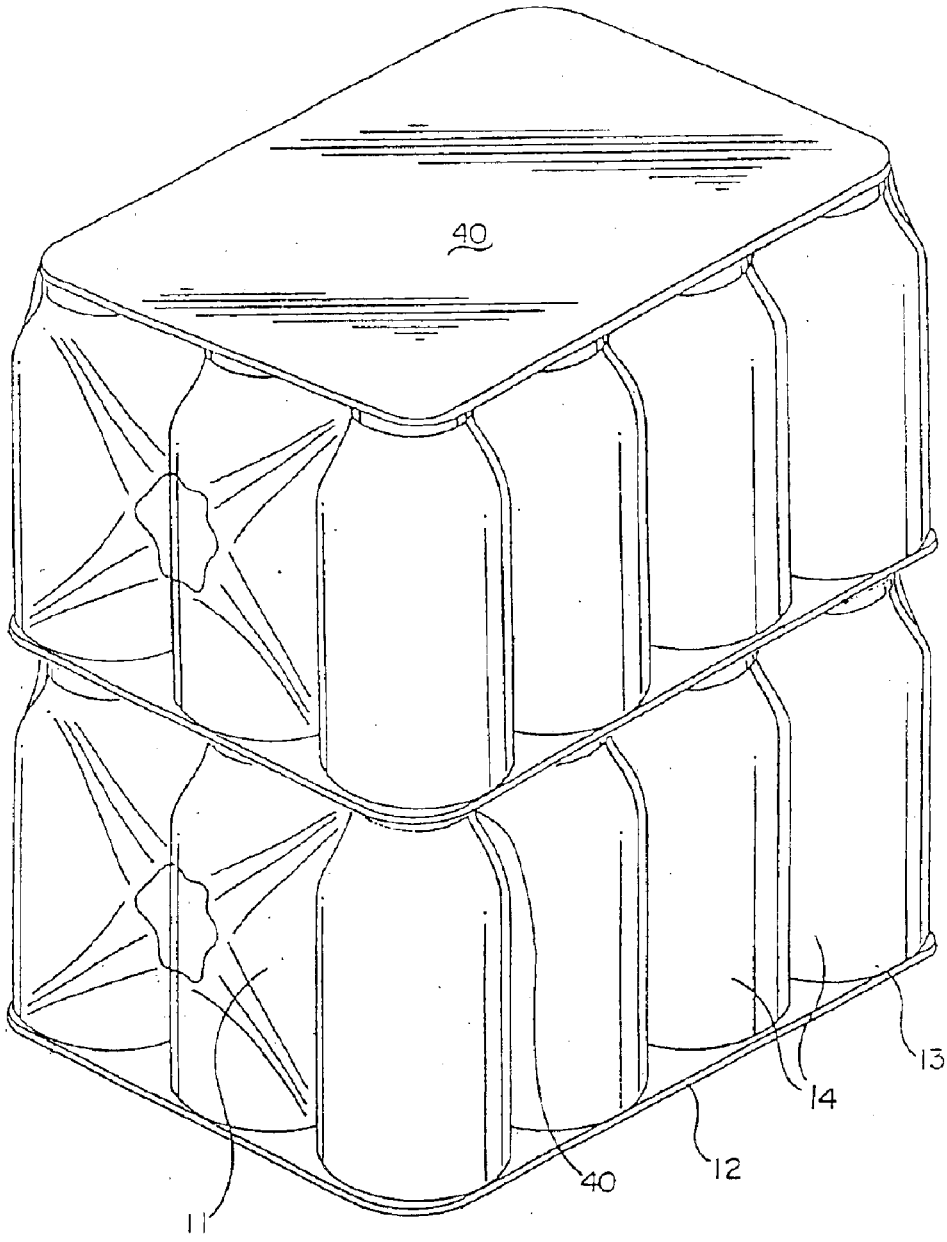
FIG. 9 is a perspective view of a grouping of containers of the present invention showing stacked layers of base members with bonded containers encapsulated with shrink film.
Figure 10:
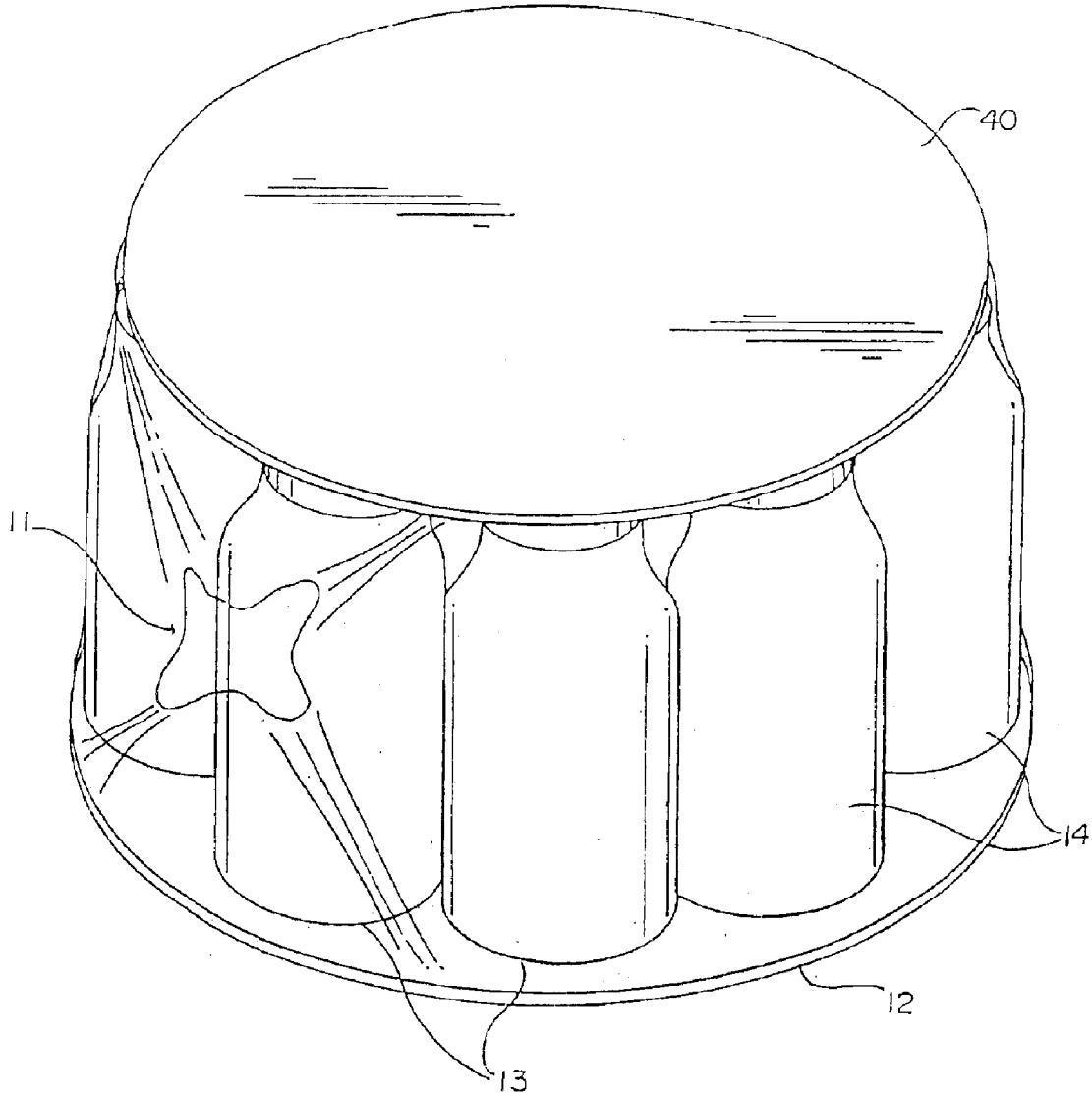
FIG. 10 is a perspective view of a grouping of containers of the present invention on a circular base member encapsulated with shrink film.

Additional embodiments of the invention are shown in FIGS. 9 and 10. FIG. 9 shows an embodiment in which multiple layers of base members with bonded containers are stacked. FIG. 10 shows an embodiment in which a circular base member is used.

Other advantages of the method of the present invention are as follows. The temporary bond effectively eliminates individual movement of the container on a flat base member during package assembly or handling, thereby greatly enhancing stability of the package assembly, which results in greater packaging efficiency. This improved stability increases the range of containers which are candidates for packaging by means of a flat base member, and it reduces the need for the packaging or handling equipment to maintain control of container movement after the container has been placed on the flat base member, thereby reducing equipment costs.

Additionally, for containers that are placed into boxes or trays for conveying through a heat transfer process, the present invention offers greater heat transfer due to the flat base member. The present invention permits greater airflow than a box or tray, thereby improving heat transfer.

This completes the description of the preferred and alternate embodiments of the invention. Those skilled in the art may recognize other equivalents to the specific embodiment described herein which equivalents are intended to be encompassed by the claims attached hereto.

What is claimed is:

1. A package utilizing a temporary bond, comprising a substantially rigid planar base member, a plurality of containers, the plurality of containers removably bonded to the base member by an adhesive, the removable bond being a temporary bond, and plastic shrink film encapsulating the base member and containers;

whereby after encapsulation of the base member and containers with plastic shrink film, the containers will self-release from their temporary bond to the base member.

2. A package utilizing a self-releasing bond, comprising a substantially rigid planar base member, a plurality of containers, the plurality of containers removably bonded to the base member by an adhesive, the removable bond being a self-releasing bond, and plastic shrink film encapsulating the base member and containers;

whereby after encapsulation of the base member and containers with plastic shrink film, the containers will self-release from their temporary bond to the base member.

3. A package utilizing a temporary self-releasing bond, comprising a substantially rigid planar base member, a plurality of containers, the plurality of containers removably bonded to the base member by an adhesive, the removable bond being a temporary self-releasing bond, and plastic shrink film encapsulating the base member and containers;

whereby after encapsulation of the base member and containers with plastic shrink film, the container will self-release from their temporary bond to the base member.

* * * * *